US005083331A

United States Patent [19]

Schnelle et al.

[11] Patent Number: 5,083,331

[45] Date of Patent: Jan. 28, 1992

[54] MOBILE PATIENT SUPPORT SYSTEM

[75] Inventors: Eberhard Schnelle, Rastatt; Reinhard Pfeuffer, Elchesheim-Illingen, both of Fed. Rep. of Germany

[73] Assignee: Stierlen-Maquet AG, Rastatt, Fed. Rep. of Germany

[21] Appl. No.: 698,301

[22] Filed: May 10, 1991

[30] Foreign Application Priority Data

May 14, 1990 [DE] Fed. Rep. of Germany ..... 4015471

[51] Int. Cl.[5] ..... A47C 19/00

[52] U.S. Cl. ..... 5/60; 5/63; 5/86; 403/327; 403/331

[58] Field of Search ..... 5/60, 63, 65, 81, 86; 403/327, 330, 331; 269/322, 323

[56] References Cited

U.S. PATENT DOCUMENTS

| | | | |
|---|---|---|---|
| 2,739,785 | 3/1956 | Gray | 5/63 X |
| 3,362,704 | 1/1968 | Pilz | 5/66 X |
| 3,397,411 | 8/1968 | Rossi | 5/63 X |
| 3,504,386 | 4/1970 | Rossi | 5/86 X |
| 3,526,040 | 9/1970 | Young | 403/327 X |
| 3,631,546 | 1/1972 | Eliasson | 5/86 X |
| 3,846,853 | 11/1974 | Jacobsson | 5/60 |
| 4,078,269 | 3/1978 | Weipert | 5/63 |
| 4,592,104 | 6/1986 | Foster et al. | 5/66 |
| 4,685,160 | 8/1987 | Rizzardo | 5/60 X |

*Primary Examiner*—Gary L. Smith
*Assistant Examiner*—Michael J. Milano

[57] ABSTRACT

A mobile patient support system includes a table plate, a support column for supporting the table plate and a transport carriage for transporting the table plate. Two pin-shaped connecting elements arranged on the table plate are receivable in complementary pin receivers of the support column for connection therewith. The table plate is transferrable by relative motion between the transport carriage and the support column from the support column to the transport carriage and the reverse. The table plate and the support column on one hand are provided with latching means and the table plate and the support column on the other hand are likewise supplied with latching means for exchangeable engagement with one another. On each connecting element are at least two latching members supported for movement between a latching position and a free position, and during the transfer process they are simultaneously insertable in a pin receiver of the column and a pin receiver of the transfer carriage. In each pin receiver is a latching recess for receiving one of the latching members in its latching position and a control surface arranged for association with the other latching element which control surface upon insertion of the connecting element transfers the latter latching member to its free position.

10 Claims, 6 Drawing Sheets

Figure 2:
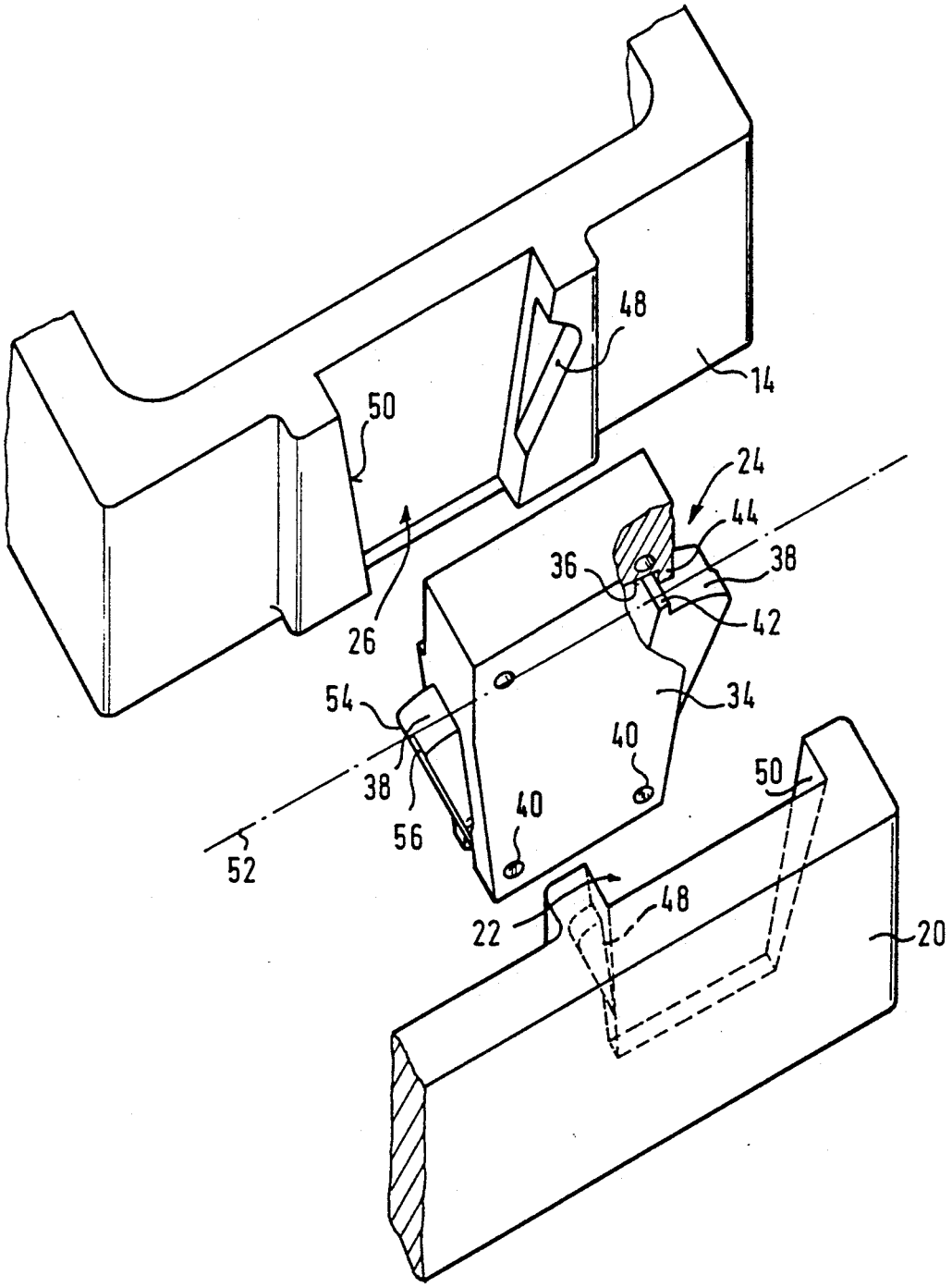

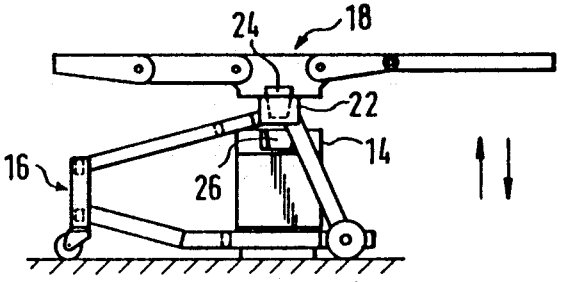
Fig. 1b
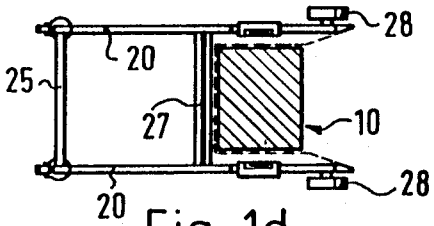
Fig. 1d
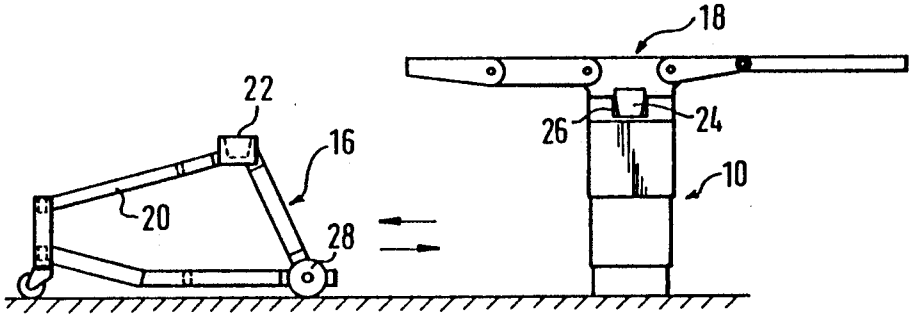
Fig. 1g
Fig. 1f
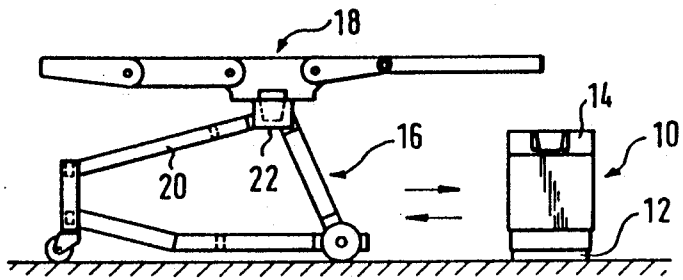
Fig. 1a
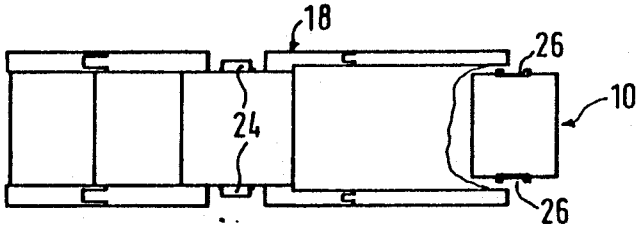
Fig. 1c
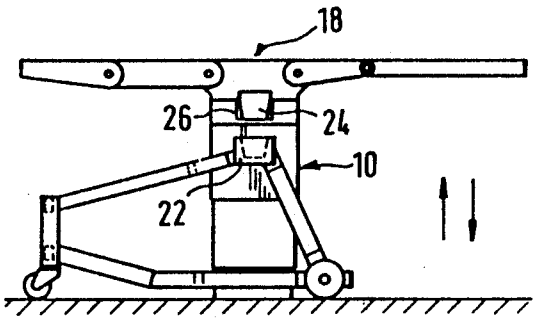
Fig. 1e

MOBILE PATIENT SUPPORT SYSTEM

The invention concerns a mobile patient support system including a table plate, a support column for supporting the table plate and a transport carriage for transporting the table plate. The table plate has arranged on it at least two pin-shaped connecting elements insertable into complementary pin receivers of the support column, and the table plate by means of relative motion between the transport carriage and the support column is transferrable between the support column and the transport carriage. Special latching means are provided between the table plate and the support column on one hand and between the table plate and the transport carriage on the other hand permitting exchangeable engagement with one another.

In a known system of the above described type the connection of the table plate with the support column takes place in such customary way that a pair of cylindrical pins with vertically directed axes and located on the underside of the table plate engage with correspondingly formed receiving openings in the support column.

To prevent an unintention lifting of the table plate from the pin receivers if a vertically directed force is imposed on the table plate, two latches are provided at another position on the table plate one of which is captured by a form element of the support column and the other of which engages with a corresponding form element on the transport carriage.

For transfer of the support plate to the transport carriage the transport carriage is brought to a suitable position relative to the support column. By means of lowering movement of the height adjusting mechanism of the support column the table plate is then lowered until it lies upon the transport carriage. Upon further lowering movement of the height adjusting mechanism of the support column the support column is separated from the table plate now lying on the transport carriage, before which the latching between the support column and the table plate must be released by supplemental means.

This patient support system has given satisfactory service in the past. It requires however great care in the manufacturing of the parts which are to be connected with one another as well as also in its handling during the transfer of the table plate. The positioning of the table plate on the transport carriage for transfer to the support column must be very exact in order to achieve the required position of the pins relative to the receiving bores. Slight tilting about the longitudinal and/or transverse axis of the table plate, as for example can occur because of an unsymmetrical loading of the table plate contains the danger of a disturbance of the transfer process since it can cause the pins to tilt in the receiving bores.

A further unfavorable situation with regard to manufacturing technique resides also in the marked breakdown of the connecting means between the table plate and the support column on one hand and between the table plate and the transport carriage on the other hand. The connection of the table plate with the support column and with the transport carriage is achieved by special connecting and securing elements which are spaced from one another and in other ways require otherwise usable construction room.

The invention has as its object the provision of a mobile patient support system of the foregoing type in which the connecting and securing means require little room and which is simple in operation as well as tolerant of errors in the transfer process.

This object is solved in accordance with the invention in that on each connecting element at least two latching members are so moveably supported that they are adjustable between a latching position and a free position and in the transfer process simultaneously project into a pin receiver of the support column and into a pin receiver of the transport carriage, and that in each pin receiver is both a latching recess for receiving one of the latching elements in its latching position and a control surface so arranged relative to the other latching element that upon insertion of the connecting element the latter latching element is transferred to its free position, so that each latch member of a connecting element has associated with it a latch recess in one pin receiver (of the column, of the carriage) and a control surface in the other pin receiver (of the carriage, of the column) associated with the same connecting element.

In the inventive solution the same connecting elements on the support plate serve for connection with the support column as well as for connection with the transport carriage. If the table plate is correctly connected with the transport carriage or with the support column then it is also automatically correctly arranged with respect to the other part so that upon the transfer from one part to the other alignment problems no longer exist. Therefore, the tolerance in respect to the positioning accuracy of the connecting pins relative to the receivers in the support column and in the transport carriage is greater. An angular displacement between the connecting pins and the receivers is no longer to be feared. The connection between the table plate and the support column as well as between the table plate and the transport carriage is limited to a small area. Because of the fact that in each pin receiver a latching recess for a latch member and a control surface for the other latch member is provided and the fact that the latching recess and the control surface in the pin receiver of the other associated part (support column, transport carriage) are oppositely arranged the result is that upon the transfer an automatic release and latching results. So long as the connecting elements are entirely inserted simultaneously in the pin receivers of the support column and of the transport carriage both of the latching members of each connecting element are positioned in their unlatched positions. At the moment however when the support column or the transport carriage separates from the table plate one of the latching elements of each connecting element becomes effective in the pin receiver of the associated other part (transport carriage, support column) so that the table plate is secured to its supporting part. An unsecuring or a securing by ways of additional means is therefore no longer required. In this connection it is desirable if the latching members are biased toward their latching positions so that they do not require special actuation.

An easy insertion of the connecting elements into the pin receivers is to be achieved if the connecting elements project downwardly from the longitudinal side edges of the table plate and if they diminish in size in progressing downwardly, with the pin receivers being formed with complementarily tapered guide surfaces.

The simultaneous insertion of the connecting elements into the pin receivers associated with them of the support column and of the transport carriage is assured in a simple way in that each of the two pin receivers associated with a connecting element surrounds only a portion of its circumference.

In a preferred embodiment of the invention the latch members are formed as members pivotally supported in the associated connecting element with each latch member having two sections one of which is intended for reception in the latching receiver of one pin recess of the support column or of the transport carriage and the other of which is intended for engagement with the control surface of the pin receiver of the other part (transport carriage, support column). In the case of a less than precise finishing of the parts a trouble-free unlatching is possible before the table plate is removed from its supporting part if the section of the latch member intended for engagement with the control surface extends slightly beyond the section of that latching member intended for reception in the latching recess.

A simple positioning of the transport carriage relative to the support column can be assured if the pin receivers of the column are arranged on two opposite sides of the column head and if the pin receivers of the transport carriage are provided on the inner sides of two support arms of the transport carriage which arms in the transfer position receive the support column between them.

If necessary the transport carriage and the support column can be provided with centering means which in the transfer position engage one another to bring the pin receivers of the column and of the transfer carriage into alignment with one another.

Further features and advantages of the invention are given in the following description which in connection with the accompanying drawings explain the invention by way of an exemplary embodiment. The drawings are:

FIGS. 1*a* to 1*g* Schematic sketches explaining the functions of the mobile patient support system.

FIG. 2 A partially schematic perspective fragmentary representation of a connecting pin element and of the associated pin receivers of the support column and of the transport carriage.

Figure 3:
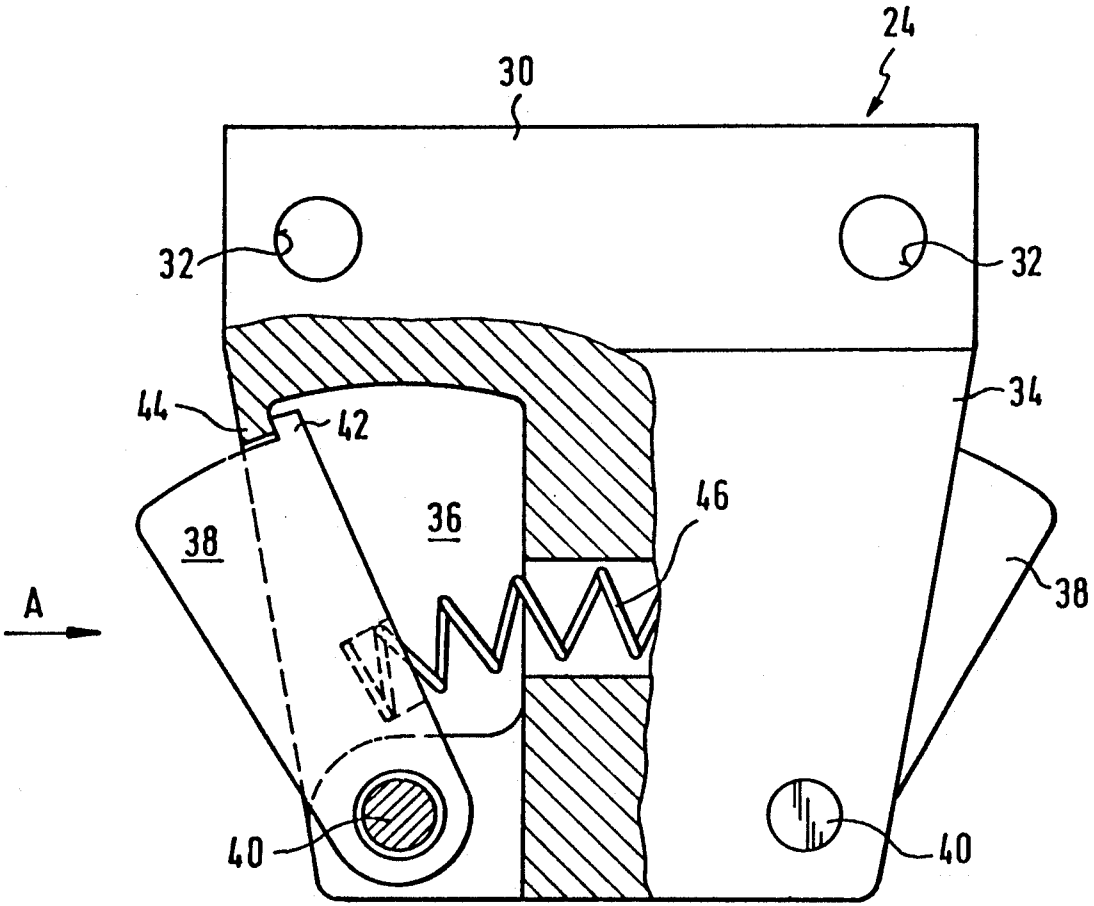

FIG. 3 A side view, partially in section, of a connecting element.

Figure 4:
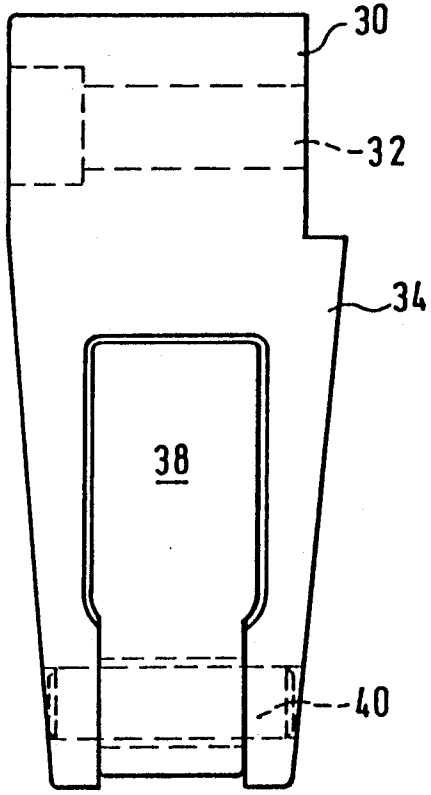

FIG. 4 A front view of the connecting element of FIG. 3 taken in the direction of the arrow A of FIG. 3.

Figure 5:
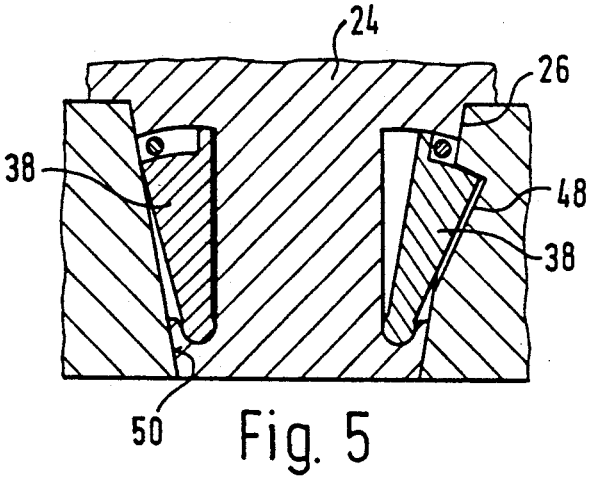

FIG. 5 schematic sectional view illustrating a connecting element latched in the pin receiver of the support column.

Figure 6A:
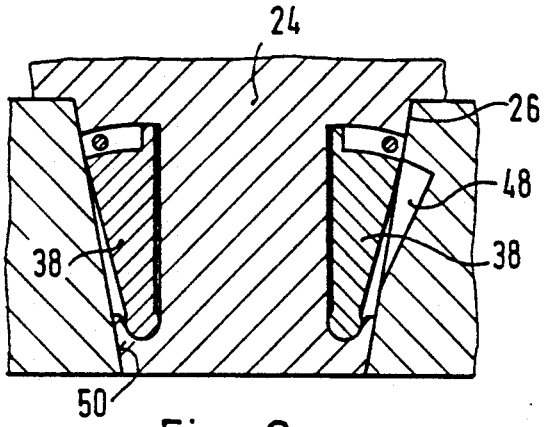
Figure 6B:
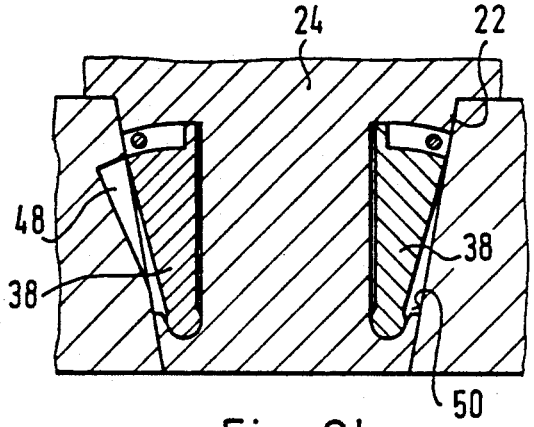

FIG. 6*a* and FIG. 6*b* An illustration corresponding to FIG. 5 of a connecting element which is received in the pin receiver of the support column as well as in the pin receiver of the transport carriage.

Figure 7:
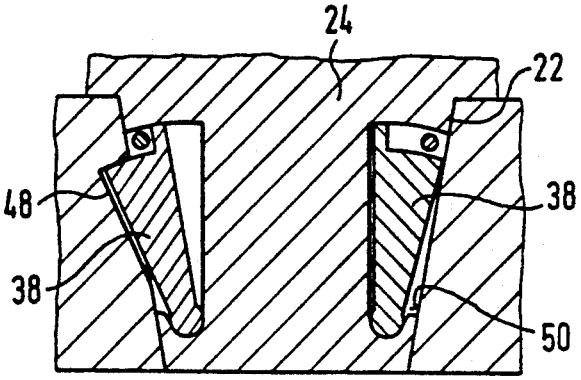

FIG. 7 An illustration corresponding to FIG. 5 of a connecting element received in the pin receiver of the transport carriage.

Figure 8:
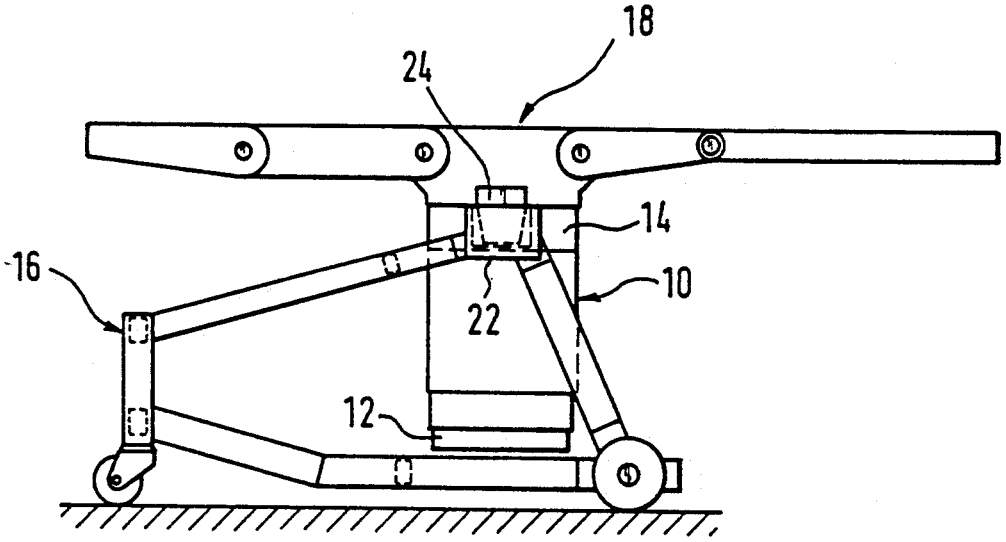

FIG. 8 An illustration of the patient support system corresponding to FIG. 1*a* wherein the support column together with the table plate is carried by the transport carriage.

Figure 9:
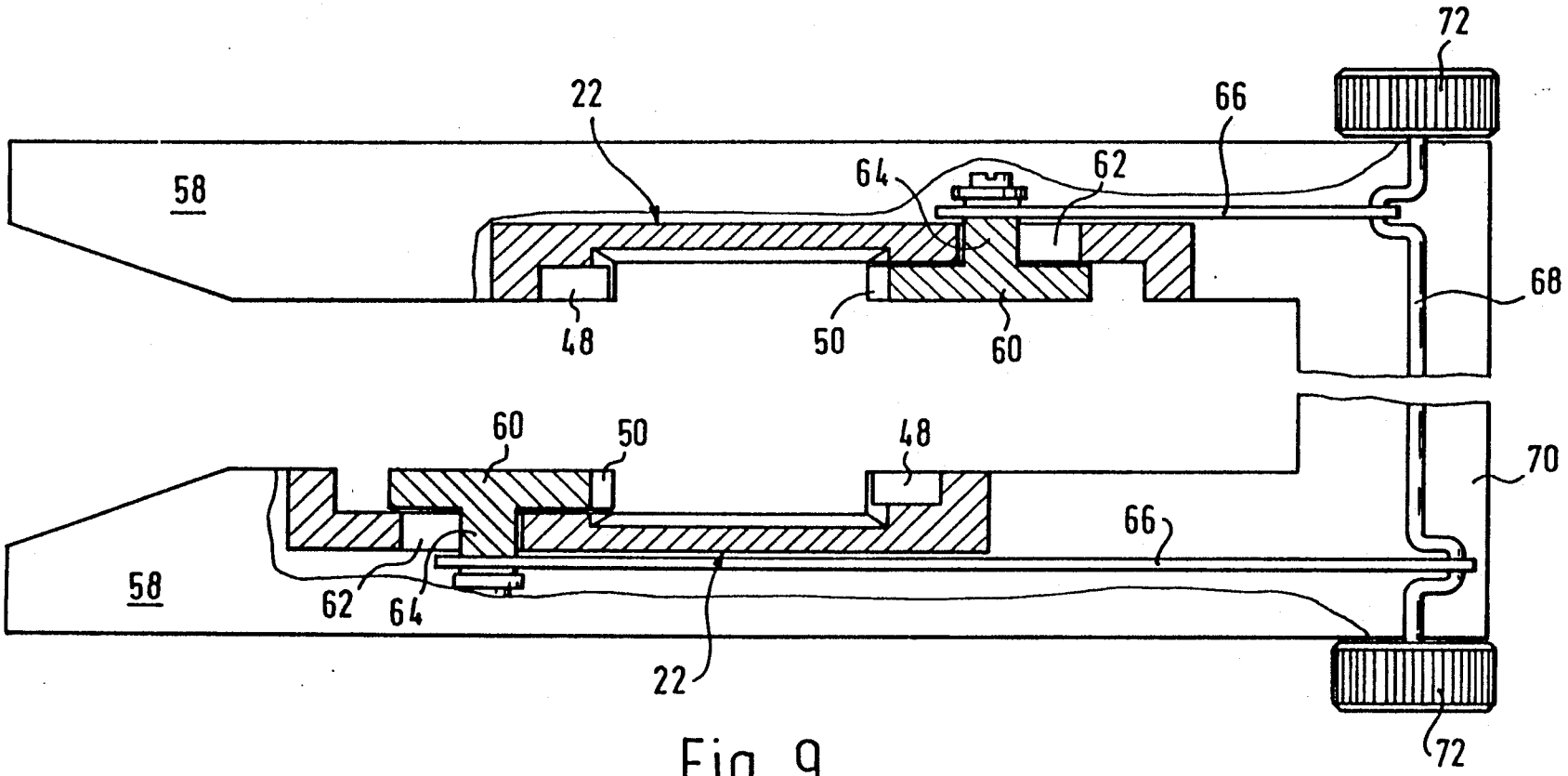

FIG. 9 A partially schematic plan view of the support arms of the transport carriage forming pin receivers wherein the control surface of each pin receiver is formed by an adjustable part.

FIG. 1*a* shows an operating table support column, indicated generally at 10, with a column foot 12 and a column head 14 supported on the column foot and adjustable in height relative to it. The height adjustment apparatus is not illustrated and can be made in any customary way. As a rule it is usually in the form of a hydraulic or mechanical raising and lowering apparatus.

To the left of the support column is a transport carriage indicated generally at 16 carrying a support surface means or table plate 18 of the operating table. The transport carriage 16 consists of two side frame parts 20 connected with one another by cross beams (FIG. 1*d*). The cross beams 25,27 are located in a middle area so that the intermediate space between the side frames 20 is freely accessible from the rollers 2 at the right end of the transport carriage in FIG. 1 up to the cross beams 25,26. Therefore, the transport carriage can be so moved toward the support column 10 that the support column comes to lie between the frame parts 20 as can be seen from the schematic plan view of FIG. 1*d* of the transport carriage and of the support column which is shown in section.

At the upper end of the somewhat unsymmetrically formed side frames 20 are pin receivers 22 intended for receiving connecting pin elements 24 arranged on the longitudinal side edges of the table plate 18 and extending downwardly from it. The exact shape of the connecting elements and of the pin receivers is explained in more detail later in connection with other figures. On the two opposite sides of the column head 14 are likewise pin receivers 26 so arranged and aligned that they in the position of the transport carriage 16 relative to the support column 10 illustrated in FIG. 1*d* lie opposite to the pin receivers 22 of the transport carriage 16.

For transferring the table plate 18 from the transport carriage 16 to the support column 10 the transport carriage 16 is moved to the position relative to the support column 10 illustrated in FIG. 1*b*. In this position the connecting elements 24 stand exactly above the pin receivers 26 of the column head 14. Subsequently the column head 14 is raised by the internal raising and lowering mechanism until the connecting elements 24 of the table plate 18 are entirely inserted into the pin receivers 26 of the column head 14. At this point of time the connecting elements 24 are received simultaneously in the pin receivers 22 of the transport carriage 16 and in the pin receivers 26 of the column head 14.

Now, in accordance with FIG. 1*e*, the column head 14 is further raised until the table plate 18 has its connecting elements 24 lifted out of the pin receivers 22 of the transport carriage 16. The transport carriage can then be removed (FIG. 1*f*). The operating table can in the usual way and according to need be adjusted to the desired working height (FIG. 1*g*). In the transfer of the table plate from the support column 10 to the transport carriage the process described above is reversed.

The table plate 18 must be latched to the support column 10 and also to the transport carriage to hinder any unintentional detachment of the support plate from its momentary supporting apparatus. How this latching and unlatching occurs during the transfer of the table plate from the support column to the transport carriage 16 or the reverse is now explained in more detail in connection with the further figures.

In FIGS. 3 and 4 the connecting elements 24 are illustrated in more detail. Each connecting element 24 includes a rectangular-shaped flange part 30 with bores 32 through which bolts can be passed for fastening the connecting element 24 to the table plate 18. Connected in one piece with the flange part 30 is a trapezoidally-shaped base body 34 which diminishes in proceeding away from the flange part 30 both in the side view as well as in the front view, as can be seen by a comparison of FIGS. 3 and 4. The base body has on its face or small sides two fork-like recesses 36 in each of which a latch member 38 is pivotally supported for movement about an axis 40. Each latch member 38 has on its inner upper edge a stop 42 which prevents it from pivoting out of the recess 36 by engagement with a cooperating stop 44 on the base body 34, as evident from FIG. 3. Both of the latch members 38 are biased toward their outward pivot positions by a single helical compression spring 46 working between them.

The pin receivers 2 of the transport carriage and the pin receivers 26 of the column head 14 are formed identically. Their shape suits that of the base bodies 34 of the connecting elements 24, however they each surround only half of the associated connecting element 24. The two pin receivers 22 and 26 associated with a connecting element 24 form when their open sides are turned toward one another a recess which entirely surrounds the connecting element. In this it is essential that each pin receiver have on only one of the side faces turned toward the front face of the connecting element 24 a latch member receiving recess 48 while the other side face 50 is smooth and provides a control surface.

If the connecting element is inserted into the pin receiver of the column head (FIGS. 2 and 5) the right latch member of these figures can enter into the associated latching recess 48. The left latch member of these figures on the other hand will be pressed against the smooth control face 50 by the force of the spring 46 in the base body 34 of the connecting element 24, as illustrated in FIG. 5. In connection with this it is to be noted that the latch members 38 in the direction of their axes lie only halfway inside the pin receiver 26 of the column head 14. The plane normal to the axes up to which the connecting elements lie inside the pin receiver 26 of the column head 14 is indicated at 52 in FIG. 2.

FIG. 7 illustrates the other condition in which the connecting element 24 is inserted in the pin receiver 22 of the transport carriage 16. In this case the left latch member 38 latches into the associated latch recess 48 while the right latch member is pressed inwardly into the base body 34 of the connecting element 24 by the smooth control surface 50. From the illustrations of FIGS. 5 and 7 it is seen that support plate 18 is latched to the column head 14 as well as to the support carriage 16 and is thereby secured.

In the case of a transfer, however, there exists a point at which the connecting element 24 is received simultaneously in the pin receiver 22 of the transport carriage and in the pin receiver 26 of the column head 14. This condition is illustrated in FIG. 6. In this connection FIG. 6*a* shows the condition with respect to the column and FIG. 6*b* with respect to the transport carriage. Since each of the latch members engage a flat control surface 50, that is the left latch member the control surface 50 of the pin receiver 26 of the column head and the right latch member the control surface 50 of the pin receiver 22 of the transport carriage 16, the two latch members are both pressed into the base body 34 of the connecting element 22 and are therefore unlatched. This can be recognized from the right side of FIG. 6*a* and the left side of FIG. 6*b*. This unlatching is achieved automatically at the moment when the pin receivers of the column head and of the transport carriage attain the same height. If now proceeding from this position the column head 14 is lowered relative to the transport carriage, the transport carriage takes on the table plate, the left latch member of FIG. 6*b* can enter into the associated latch recess 48 of the pin receiver 22 of the transport carriage and thereby secure the table plate 18 to the transport carriage. If proceeding in the reverse manner from the illustrated position of FIG. 6 the column head 14 is raised for transferring the table plate 18 from the transport carriage 16, the right latch member 16 is freed from the control surface 50 and can enter into the right latch recess of the pin receiver 26 of the column head 14. Therefore in this case also the table plate 18 is automatically latched to the column head 14.

FIG. 2 illustrates further a special development of the latch member which however is not absolutely necessary. It shows that the section 54 of a latch member intended to engage a control surface extends slightly outwardly from the section 56 of the same latch member intended to enter into a latch recess 48. Therefore, it is assured that even in the case of inexact finishing in all cases an unlatching of one latch member results before the other latch member can enter into its associated latch recess 48 in the other part. However if sufficiently exact finishing of the coengaging parts is accomplished this precautionary measure is not necessary.

The entire operating table can also be transported by the transport carriage 16 in a way known in itself. As to this attention is directed to FIGS. 1*e* and 8. If in the position illustrated in FIG. 1*e* the raising and lowering mechanism of the support column is actuated in the sense to lower the column head 14 together with the table plate 18 the connecting elements 24 ar inserted into the pin receivers 22 of the transport carriage 16 until the transport carriage takes on the table plate 18. If the raising and lowering mechanism of the support column 16 is then further actuated in the sense of lowering the column head 14 the position illustrated in FIG. 1*b* would normally be attained. However, if the latching between the table plate and the support column 10 is not released then instead of a lowering of the column head 14 the column foot 12 is raised. The support column 10 then hangs free from the table plate 18 as illustrated in FIG. 8.

In order to not have to supply any additional latching elements, which then have to be specially actuated, to distinguish between the conditions illustrated in FIGS. 1*b* and 8 the control surfaces 50 in the pin receiver 22 of the transport carriage 16 are moveably or adjustably arranged so that they can be moved into a position in which the latch members 38, which assure the connection between the table plate 18 and the support column 10, cannot be moved out of their latching positions when the connecting element 24 upon lowering of the table plate 18 from the position illustrated in FIG. 1*e* is inserted into the pin receiver 22 of the transport carriage 16.

An adjusting mechanism for the control surfaces is illustrated in FIG. 9. The pin receivers 22 are here formed on the support arms 58 of the transport carriage. Each control surface 50 is formed on an associated block 60 which is slidably guided in the support arm 58 by a pin 64 passing through a slot 62 in the support arm. In general several such pin and slot guides are provided in order to prevent a turning of the block 60 on the support arm 58.

The blocks 60 are connected with one another by associated connecting rods 66 connected to a crank shaft 68 supported by a cross beam 70 connecting together the two support arms 58. The connection of the connecting rods 66 with the crank shaft 68 is such that upon rotation of the crank shaft 68, which can be rotated by the knurled knobs 72 connected to it, the blocks 60 are oppositely adjusted in the two pin receivers 22. That is, the crank shaft sections which are connected to the connecting rods 66 are approximately 180° displaced from one another.

In the positions of the blocks 60 illustrated in FIG. 9 the control surfaces 50 are located in their effective positions in that they pivot the latch members 38 facing them into the connecting elements 24 and thereby the latching between the latching members 38 and the support column 10 is disengaged.

If this unlatching is to be discontinued, the crank shaft 70 by the help of the knurled knobs 72 is turned in the sense that the upper block 60 of FIG. 9 is adjusted toward the right and the lower block 60 of FIG. 9 is adjusted toward the left. Thereby the control surfaces 50 are shifted to such an extent that upon the insertion of the connecting elements 22 into the associated pin recesses 22 the latching members 38 facing the control surfaces are not disturbed by the control surfaces and therefore cannot deflect. The latching members remain in their latching position in which they rigidly connect the column 10 with the table plate 18. In this position of the blocks 60 and of their control surfaces 50 the column foot can be lifted to the position illustrated in FIG. 8 and thereupon the entire operating table can be moved with the help of the transport carriage 16.

We claim:

1. A mobile patient support system including a table plate (18), a support column (10) for supporting the table plate (18) and a transport carriage (16) for transporting the table plate (18) with the table plate having associated with it at least two pin-shaped connecting elements (24) which are insertable into complementary pin receivers (26) of the support column (10) for connection with the support column, wherein the table plate (18) is further transferrable by means of relative motion between the transport carriage (16) and the support column (10) from the support column to the transport carriage and the reverse, and wherein latching means are provided on the table plate and the support column on one hand and between the table plate and the transport carriage on the other hand for exchangeable engagement with one another, characterized in that at least two latching members (38) are moveably supported on each connecting element (24), that each latching member is movable between a latching position, that in the transfer process said two latching members of each connecting element are simultaneously receivable in a pin receiver of the support column and a pin receiver of the transfer carriage, and in that in each pin receiver (26;22) a latching recess (48) is provided for receiving one of the latching members (28) in its latching position and a control surface is provided for the other latching member (38) and so formed so that upon insertion of the connecting element said other latching element (38) is transferred to its free position, each of said latching members (38) having associated with it a latching recess (48) in one pin receiver (26;22) (of the column, of the carriage) and a control surface (50) in the other pin receiver (22;26) (of the carriage, of the column) associated with the same connecting element.

2. A patient support system according to claim 1, further characterized in that the latching members (38) are biased to their latching positions.

3. A patient support system according to claim 1, further characterized in that the connecting elements extend downwardly from the longitudinal side edges of the support plate (18) and diminish in size in proceeding downwardly with the pin receivers (26;22) having complementarily tapered guide surfaces.

4. A patient support system according to claim 1, further characterized in that the pin receivers (26;22) associated with the same connecting element (24) each surround only a portion of the circumference of that connecting element.

5. A patient support system according to claim 1, further characterized in that each latching member (38) is formed by a member pivotally supported in its connecting element, with the member having two sections (54;56) one of which is intended for reception in the latch recess (48) of a pin receiver (26;22) of the support column or of the support carriage and the other of which is intended for engagement with the control surface (50) of the pin receiver (22;26) of the other part (transport carriage, support column).

6. A patient support system according to claim 5, further characterized in that the section (54) of the latch member (38) intended for engagement with the control surface (50) extends slightly outwardly from the section (56) intended for reception in the latching recess (48).

7. A patient support system according to claim 1, further characterized in the pin receivers (26) of the support column being located on two opposite sides of the column head (14) and the pin receivers (22) of the transfer carriage being located on the inner sides of two support arms (20) of the transport carriage (16) which support arms in the transfer position receive the support column (10) between them.

8. A patient support system according to claim 7, further characterized in that centering means are provided on the transport carriage (16) and on the support column (10) which in the transfer position come into engagement with one another to bring the pin receivers of the column and of the transport carriage into alignment with one another.

9. A patient support system according to claim 1, further characterized in that the control surface (50) of each pin receivers (26) of the transport carriage is adjustable between a forward control position and a rearward position in which rearward position it does not disturb the associated latch member (38) of the connecting element (24).

10. A patient support system according to claim 9, further characterized in that the control surface of each pin receiver of the transport carriage is formed by a block (60) which is guided on the associated support arm (58) of the transport carriage (16) for horizontal shifting movement, and that the two blocks of the two pin receivers of the transport carriage are connected together through connecting rods (66) connected to a crank shaft (70) so that upon rotation of the crank shaft (70) the two blocks are adjusted in opposite directions.

* * * * *